US006053315A

United States Patent [19]

Yao

[11] Patent Number: 6,053,315

[45] Date of Patent: Apr. 25, 2000

[54] TOOL BOX HAVING A ROTATABLE LIGHT

[76] Inventor: Ghing Hsiu Yao, P.O. Box 63-99, Taichung, Taiwan

[21] Appl. No.: 09/113,816

[22] Filed: Jul. 10, 1998

[51] Int. Cl.[7] ..... A45C 15/06

[52] U.S. Cl. ..... 206/372; 206/573; 206/349; 362/154

[58] Field of Search ..... 206/349, 372, 206/573; 362/154, 156, 197, 198, 199

[56] References Cited

U.S. PATENT DOCUMENTS

| | | | |
|---|---|---|---|
| 1,284,502 | 11/1918 | Walton | 362/199 |
| 2,536,177 | 1/1951 | Harkins | 206/573 |
| 4,459,646 | 7/1984 | Drane | 362/199 |
| 4,937,713 | 6/1990 | Holt et al. | 362/199 |
| 5,188,450 | 2/1993 | Anderson | 206/573 |
| 5,541,822 | 7/1996 | Bamber | 362/199 |
| 5,685,421 | 11/1997 | Gilmore | 206/216 |
| 5,795,055 | 8/1998 | Shiao | 362/156 |
| 5,803,586 | 9/1998 | Velez et al. | 362/154 |
| 5,853,241 | 12/1998 | Sharrah et al. | 362/197 |

*Primary Examiner*—Paul T. Sewell
*Assistant Examiner*—J. Mohandesi

[57] ABSTRACT

A tool box includes a base and a cover each having an opening formed by a pair of arms which are pivotally together at a pivot pin. A light device is pivotally coupled to the base and the cover at the pivot pin, for allowing the light device to be rotated about the pivot pin and to light the cover and the base when the base and the cover are opened, such that the user may easily view and fetch the tools received in the tool box in the dark places. The cover includes a hand grip having a chamber for receiving one or more batteries and for energizing the light device.

4 Claims, 5 Drawing Sheets

TOOL BOX HAVING A ROTATABLE LIGHT

BACKGROUND OF THE INVENTION

1. Field of the Invention

The present invention relates to a tool box, and more particularly to a tool box having a rotatable light.

2. Description of the Prior Art

Typical tool boxes have no light device for lighting purposes, such that the user may not easily view and fetch the tools disposed in the tool box in the dark places.

The present invention has arisen to mitigate and/or obviate the afore-described disadvantages of the conventional tool boxes.

SUMMARY OF THE INVENTION

The primary objective of the present invention is to provide a tool box having a rotatable light for lighting purposes and for lighting the interior of the tool box.

In accordance with one aspect of the invention, there is provided a tool box comprising a base and a cover pivotally together at a pivot pin, the base and the cover each including an opening defined by a pair of arms, the arms being pivotally coupled together at the pivot pin, and a light device pivotally coupled to the base and the cover at the pivot pin, for allowing the light device to be rotated about the pivot pin and to light the cover and the base when the base and the cover are opened, such that the user may easily view and fetch the tools received in the tool box in the dark places. The tools or tool members may be received in both the base and the cover.

The cover includes a hand grip provided on top. The hand grip includes a chamber formed therein, and at least one battery disposed in the chamber for energizing the light device.

The light device includes at least one stop for engaging with the arms of the base and the cover and for limiting a rotational movement of the light device about the pivot pin.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
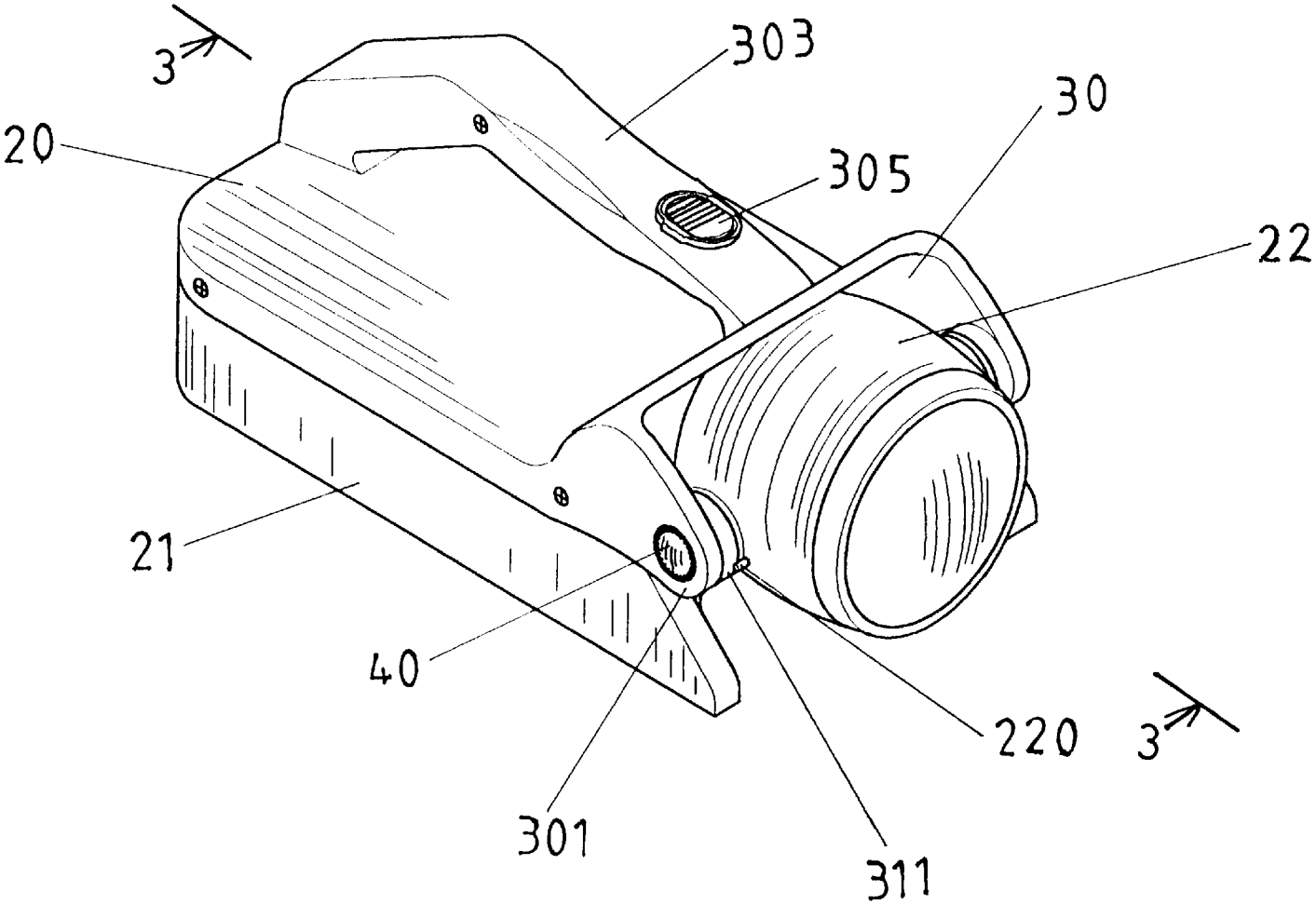
FIG. 1 is a perspective view of a tool box in accordance with the present invention.
Figure 2:
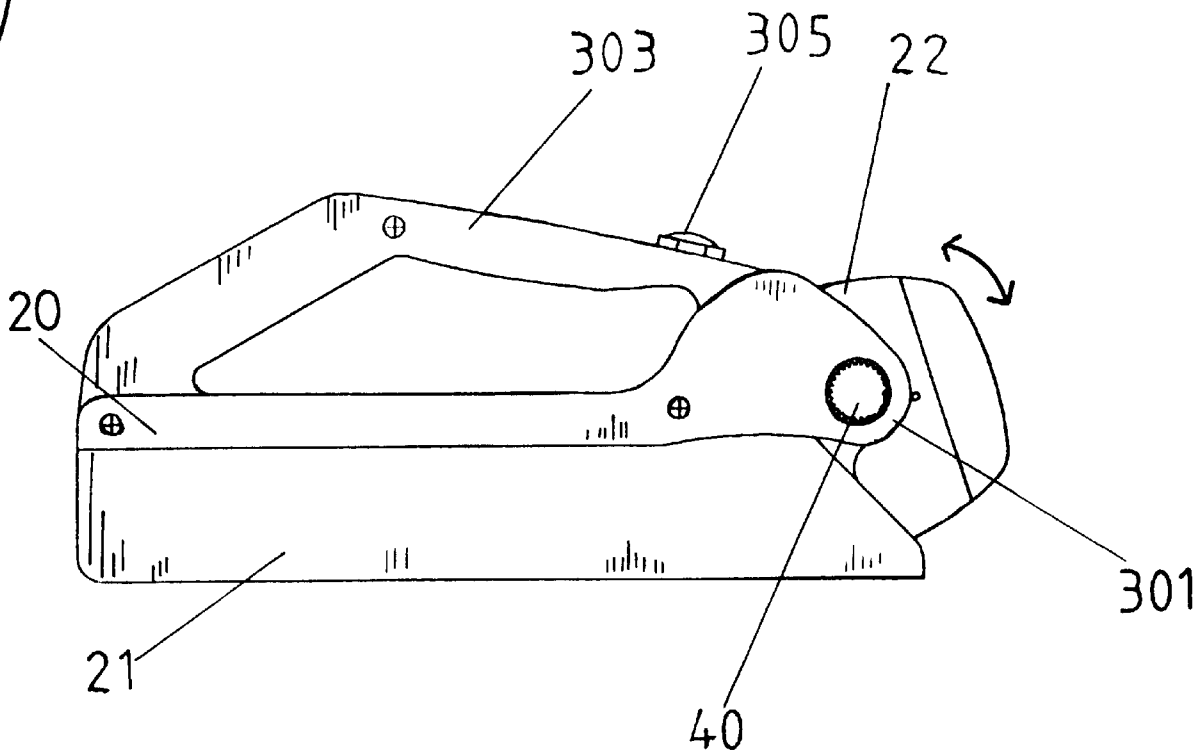
FIG. 2 is a plan view of the tool box.
Figure 4:
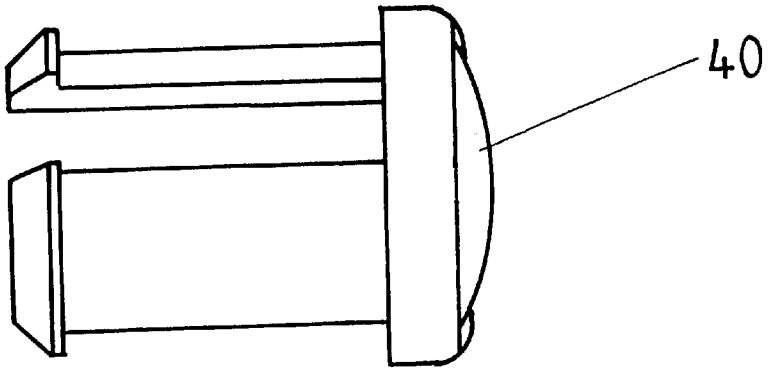
FIG. 4 is a plan view of a pivot pin.
Figure 3:
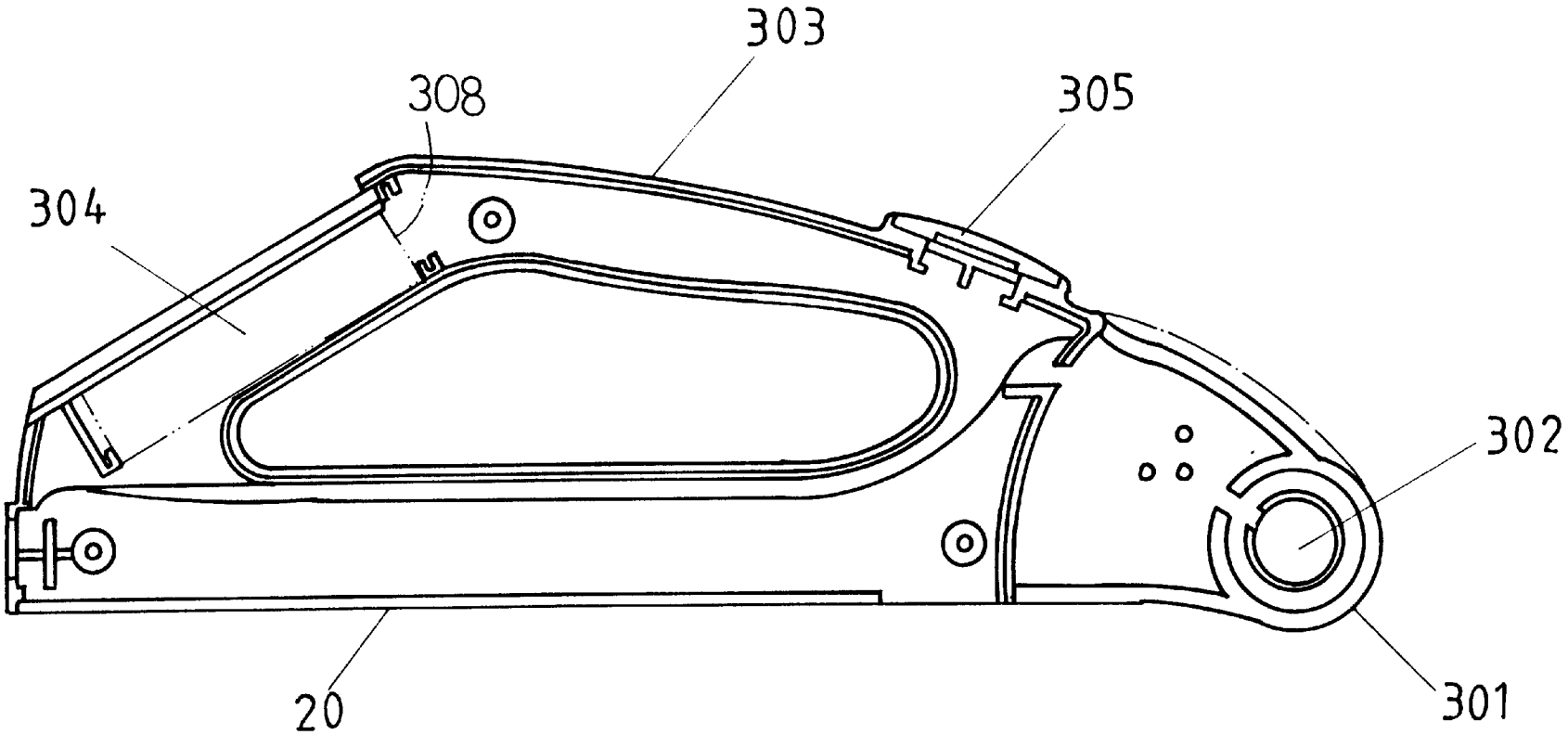
FIG. 3 is a cross sectional view taken along lines 3—3 of FIG. 1, in which the light device has been removed.

Referring to the drawings, and initially to FIGS. 1–4, a tool box in accordance with the present invention comprises a base 21 and a cover 20 pivotally coupled together by one or more pivot pins 40, for allowing the base 21 and the cover 20 to be rotated about the pivot pins 40 between an open position and an enclosed position. A light device 22 is pivotally coupled to the tool box at the pivot pins 40. The base 21 and the cover 20 each includes an opening 31, 30 defined by a pair of arms 311, 301. The arms 311, 301 each includes an orifice 302 (FIG. 3) for receiving the pivot pins 40 and for allowing the base 21 and the cover 20 to be pivotally coupled together. The cover 20 includes a hand grip 303 provided on top and having a chamber 304 formed therein for receiving one or more batteries 308 which may be used for energizing the light device 22. A knob 305 is provided in the hand grip 303 and electrically coupled to the batteries 308 for controlling the light device 22. The light device 22 preferably includes one or more stops 220 (FIGS. 1, 5, 6) for engaging with the arms 311, 301 and for preventing the light device 22 from over rotation or for limiting the rotational movement of the light device 22. The cover 20 includes a releasable latch 208 for engaging with the base 21 and for securing the cover 20 to the base 21 at the enclosed position as shown in FIGS. 1 and 2.

As shown in FIGS. 1 and 2, when the base 21 and the cover 20 are secured together in the enclosed position, the light device 22 may be rotated about the pivot pins 40 for allowing the light device 22 to be adjusted to any suitable directions.

Figure 5:
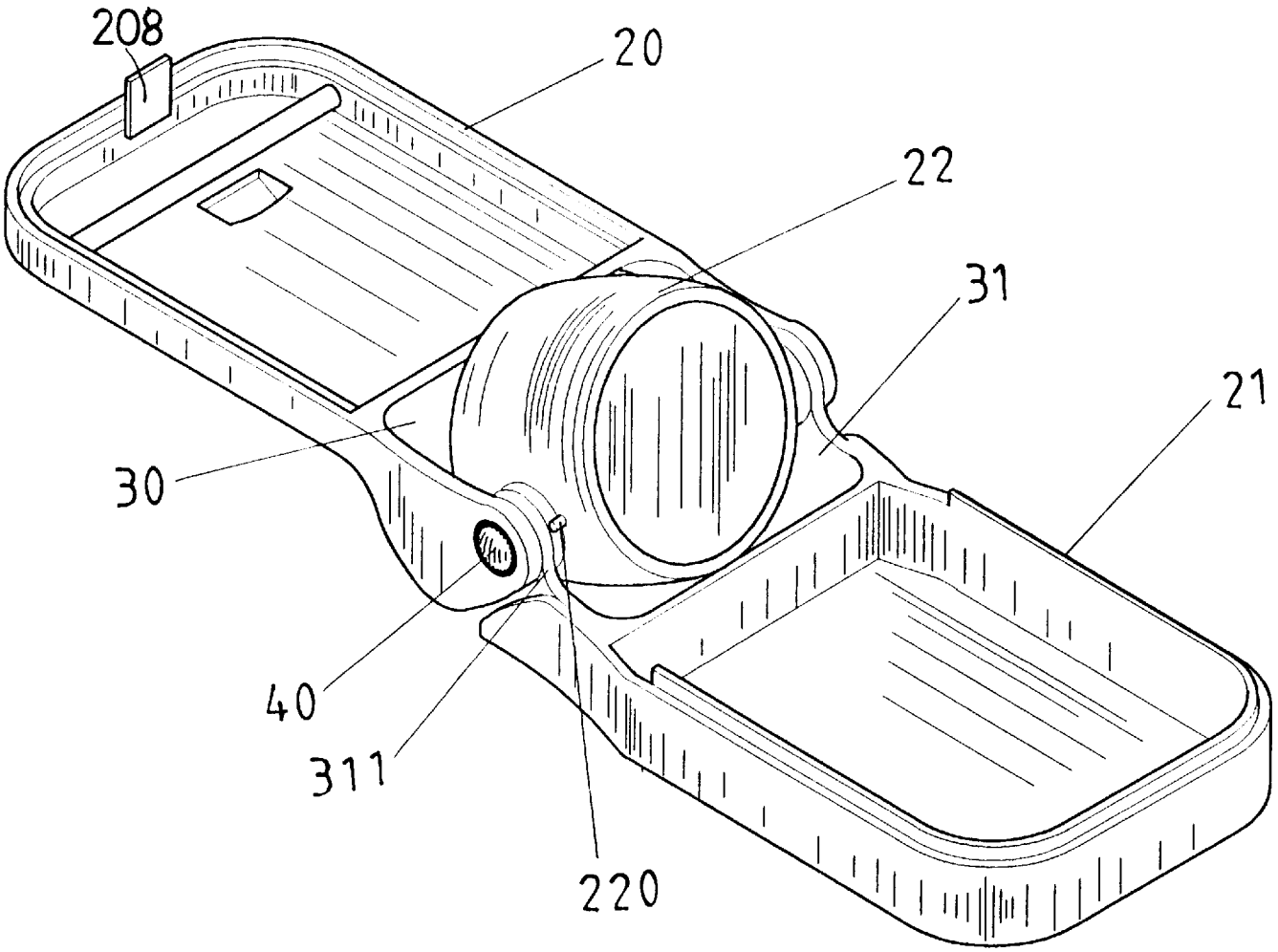
FIGS. 5 and 6 are perspective views illustrating the operation of the tool box and the light device.
Figure 6:
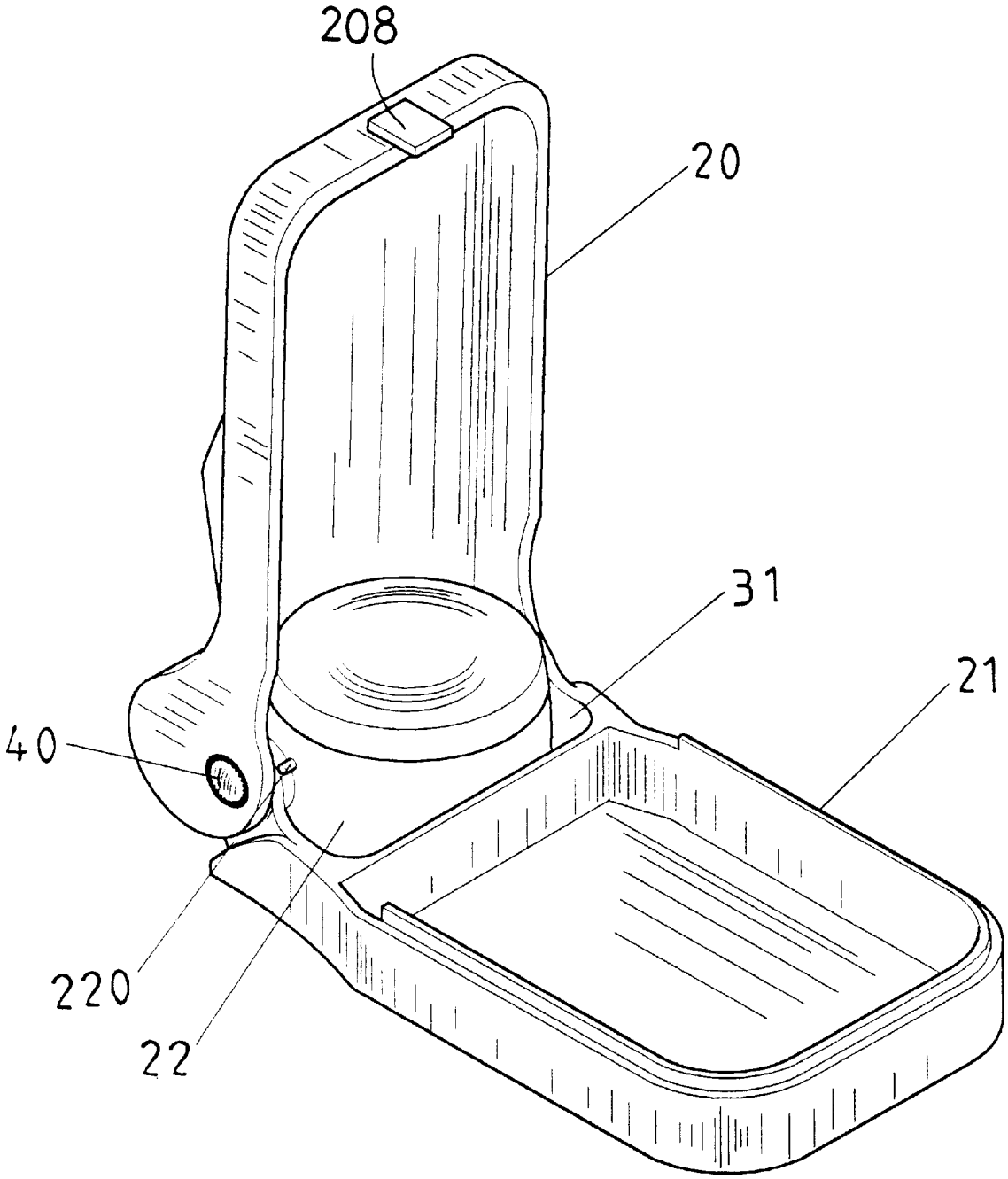

Referring next to FIGS. 5 and 6, when the tool box is opened, the light device 22 may also be rotated to light the interior of the tool box for allowing the tools received in the tool box to be easily seen and to be easily fetched in the dark places. Both the cover 20 and the base 21 may include a number of supports or clamping members for retaining the tools or tool members in the tool box.

Accordingly, the tool box in accordance with the present invention includes a rotatable light for lighting purposes and for lighting the interior of the tool box.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a base and a cover pivotally together at a pivot pin, said base and said cover each including an opening defined by a pair of arms, said arms being pivotally coupled together at said pivot pin, and a light device pivotally coupled to said base and said cover and coupled between said arms at said pivot pin and received in said opening defined by said arms, for allowing said light device to be rotated about said pivot pin and to light said cover and said base when said base and said cover are opened.

2. The tool box according to claim 1, wherein said cover includes a hand grip provided on top.

3. The tool box according to claim 2, wherein said hand grip includes a chamber formed therein, and at least one battery disposed in said chamber for energizing said light device.

4. The tool box according to claim 1, wherein said light device includes at least one stop for engaging with said arms of said base and said cover and for limiting a rotational movement of said light device about said pivot pin.

* * * * *